US007523567B1

(12) United States Patent
McClelland

(10) Patent No.: US 7,523,567 B1
(45) Date of Patent: Apr. 28, 2009

(54) PROTECTIVE COVER FOR HOCKEY SKATE BOOT

(76) Inventor: Frank McClelland, 5922 Foothills Trail, Gaylord, MI (US) 49735

( * ) Notice: Subject to any disclaimer, the term of this patent is extended or adjusted under 35 U.S.C. 154(b) by 382 days.

(21) Appl. No.: 11/559,606

(22) Filed: Nov. 14, 2006

(51) Int. Cl.
*A43B 5/00* (2006.01)

(52) U.S. Cl. ..... 36/115; 36/72 R; 36/132

(58) Field of Classification Search ..... 36/114, 36/115, 132, 72 R, 71; 280/811
See application file for complete search history.

(56) References Cited

U.S. PATENT DOCUMENTS

| | | | | | |
|---|---|---|---|---|---|
| 2,984,917 | A * | 5/1961 | Saunders | 280/811 |
| 4,351,537 | A | 9/1982 | Seidel | |
| 4,445,287 | A * | 5/1984 | Garcia | 36/106 |
| 4,453,727 | A | 6/1984 | Bourque | |
| 5,234,230 | A | 8/1993 | Crane et al. | |
| 5,498,033 | A | 3/1996 | Hoshizaki et al. | |
| 5,566,476 | A * | 10/1996 | Bertrand et al. | 36/72 R |
| 5,711,092 | A * | 1/1998 | Despres et al. | 36/72 R |
| 5,829,170 | A * | 11/1998 | Lutz, Jr. | 36/72 R |
| 5,897,446 | A * | 4/1999 | Wiseman et al. | 473/446 |
| 5,987,778 | A * | 11/1999 | Stoner | 36/1.5 |
| 6,038,792 | A * | 3/2000 | Hauter | 36/133 |
| RE37,887 | E * | 10/2002 | Yates | 36/133 |
| 6,505,422 | B2 | 1/2003 | Racine | |
| D473,703 | S | 4/2003 | Labonte et al. | |
| 6,871,424 | B2 | 1/2004 | Labonte et al. | |
| 6,769,203 | B1 | 8/2004 | Wright et al. | |
| D496,974 | S | 10/2004 | Howard | |
| 6,854,200 | B2 * | 2/2005 | Hipp et al. | 36/96 |
| D502,752 | S | 3/2005 | Howard | |
| 2003/0196351 | A1 * | 10/2003 | Hipp et al. | 36/72 R |

* cited by examiner

*Primary Examiner*—Marie Patterson
(74) *Attorney, Agent, or Firm*—Northern Michigan Patent Law, PLC

(57) ABSTRACT

A removable protective cover for a hockey skate boot, the cover having a hard but flexible protective shell with an open bottom and heel, and heel-cupping sidewall portions that flex apart diagonally to apply the cover to the boot and to grip portions of the boot heel under tension when released. The shell floats above the surface of the boot on spaced pads secured to the underside of the shell, the pads protecting side-foot, ankle, and instep portions of the foot, while still allowing the boot-laces to be adjusted while the protective cover is installed on the boot. The shell is preferably slotted on the instep to improve flexibility. The initial tensioned fit of the cover on the boot frees the user's hands from having to stabilize the cover while adjusting supplemental fasteners such as straps.

10 Claims, 3 Drawing Sheets

PROTECTIVE COVER FOR HOCKEY SKATE BOOT

FIELD OF THE INVENTION

The present invention is in the field of removable protectors or guards for hockey skate boots.

BACKGROUND OF THE INVENTION AND DESCRIPTION OF RELATED ART

Hockey pucks can cause foot and ankle injuries even through modern hard-shelled plastic boots, in part because the fit of modern hockey skate boots is intentionally tight. The problem is worsened by the use of composite-material hockey sticks, which throw the puck faster than wooden sticks. The unsportsmanlike "slashing" of another player's feet with a hockey stick can also cause foot injuries.

Tie-on or strap-on ankle protectors have been known for many years, and the present inventor can recall cardboard-and-leather and plastic-and-leather protective cups either tied or strapped onto the exterior of a hockey skate boot directly over the anklebone area.

U.S. Pat. No. 5,829,170 to Lutz, Jr. shows a removable protective shell cover molded into a boot-fitting shape, covering the upper and sides (including the ankle region), and fastened with straps running behind the heel and under the sole of the boot. The strap ends are folded and secured through slots in an effort to uniformly space the shell off the boot to allow the shell to absorb and dissipate impact away from the surface of the boot. The strap arrangement also specifically tensions the upper surface of the shell against the boot lacing on top of the boot, using the lacing to help define the gap and to serve as a cushion. The shell is molded from a flat blank with constant thickness, and thus only "approximates" the shape of the boot and does not cover or wrap around any part of the heel area.

U.S. Pat. No. 5,234,230 to Crane et al. discloses a two-layer protective device with a fabric "support layer" that secures behind the heel with hook-and-loop fastener, underneath the sole with elastic, and is tied into the boot's lace system with grommets. The support layer does not cross the top of the boot, but provides side panels equipped with hook-and-loop fastener that removably accepts thick flat protective pads. The pads have an L-shape that protects the sides of the foot and the ankle. The top of the foot can be protected with an optional pad fastened across the top of the boot and connected to the side panels of the support layer, again with hook-and-loop fastener. There is no protection of the heel area, and Lutz, Jr. criticizes the Crane et al. device as complicated to put on and take off, heavy, and prone to having the padding ripped off during a game.

U.S. Pat. No. 4,351,537 to Seidel discloses a three-part boot shell with a rigid sole/toe/heel/Achilles-supporting base portion, a soft flexible padded sock portion that drops into the base portion, and a rigid upper shell that fits over the sock and has buckles on lower side flanges and in back behind the Achilles area for rigidity and support. While protection is not the primary focus of the three-part shell, Seidel mentions that the upper shell does protect the foot. The instep area of the upper shell is flexible, and the shell has no heel or Achilles portion, so that it can "be sprung or opened" to assemble it over the sock and to cooperate with the pivoting Achilles-protector portion of the base.

The present inventor has also tried using an elongated shin guard secured around the ankle with tape or straps. Although this arrangement provides some additional protection to the ankle, it is bulky, and some argue that it impedes the legs' forward flex. Further, it does not provide any protection to the sides of the boot and only minimal protection to the lace area.

BRIEF SUMMARY OF THE INVENTION

The present invention is a removable hard-shell boot cover that fits over the top of a hockey skate boot, covering the top, sides, ankles, and cupping a portion of the heel of the boot. The shell of the boot cover is partially backed by protective padding, the padding located to float the shell portion off the boot, better allowing the boot to flex. The preferred material for the protective shell is a relatively hard but flexible plastic such as polycarbonate. The shell has a vertically-split heel contiguous with an open bottom, and preferably a one-piece construction. The shell has enough flexibility and tension that the cover can be flexed open diagonally from the heel cupping portions to fit over the top of the boot, and then released to substantially conform to the instep, sides, and a portion of the heel in a tensioned fit, with a primary flex bias running diagonally from the instep to the heel area.

While the initial tensioned fit is secure enough for casual skating, for competition the boot cover is preferably further secured with supplemental fasteners such as straps across the heel and/or sole of the boot. Elastic straps are preferred to accommodate the significant flex of the boot and cover that can occur on the "power stroke" portion of the skating motion during a hockey game. The initial tensioned fit is also secure enough to free up the user's hands for securing the supplemental fasteners.

The boot cover's shell is preferably slotted between padded areas on its upper surface over the boot instep, improving flexibility on the "power stroke" portion of the skating stride. In a preferred form, the slots are thin-walled portions of the shell, and are optionally provided with vent openings.

In a further form, the padding under the sidewall of the boot cover is separated into two spaced pads by a reinforced diagonal portion of the sidewall, with one pad corresponding to the side of the foot, and one pad corresponding to the ankle area.

These and other features and advantages of the invention will become apparent on further reading of the detailed description below, in light of the accompanying drawings.

DETAILED DESCRIPTION OF THE INVENTION

Figure 1:
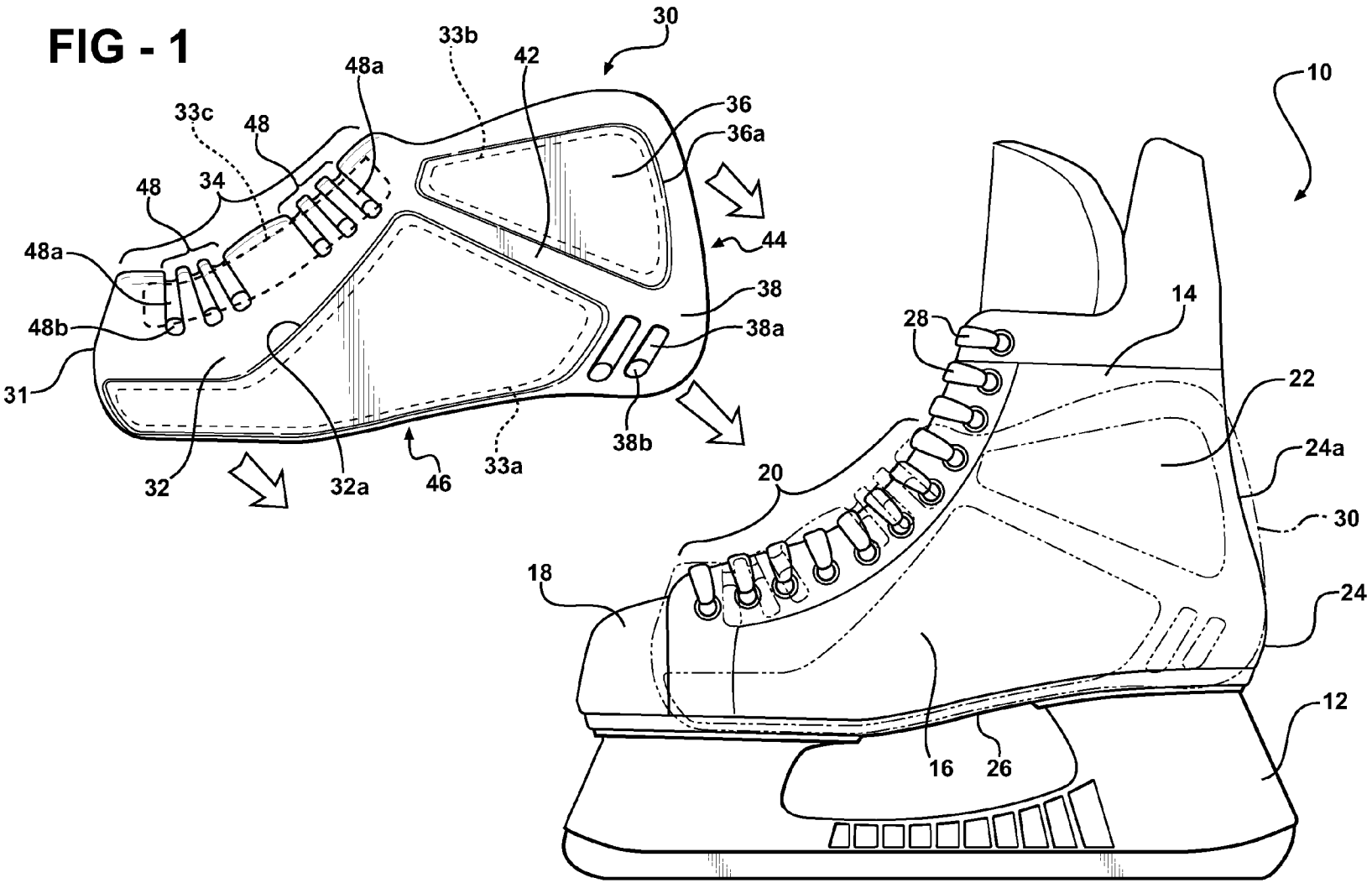
FIG. 1 is a side elevation view of a hockey skate boot with a foot-protective boot cover according to the present invention, the cover shown removed from the boot in solid lines, and fitted to the boot in phantom lines.

FIG. 1 illustrates a conventional style of hard-shelled plastic hockey skate boot 10, with a blade 12 and a boot portion 14, and a removable foot-protecting boot cover 30 according to the invention. It will be understood by those skilled in the art that manufacturing boot cover 30 to fit over one specific type or style or brand of boot will result in the best fit, but that the cover can also be manufactured to fit over more than one type or style or brand of boot, and that its proportions and shape can accordingly vary to accommodate boot styles different from that shown in the illustrated example. Boot cover 30 can of course be sized to fit different sizes of a particular type or style or brand of boot, and will generally benefit from having pairs of covers shaped differently for right and left boots. Boot cover 30 can also be manufactured with different ornamental features to enhance its appearance.

Figure 5:
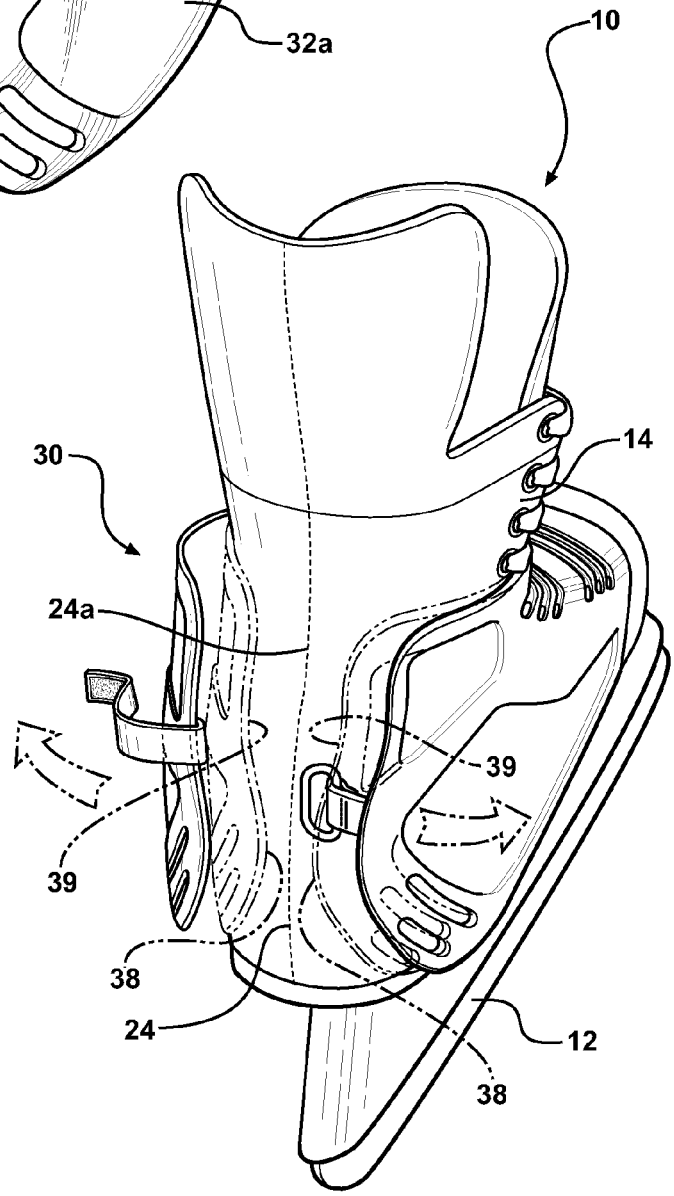
FIG. 5 is a rear perspective view of the boot cover of FIG. 1 being fitted over a boot, with the cover shown flexed open in solid lines and tensioned on the boot in phantom lines.

Boot cover 30 has an outer protective shell 31 preferably molded or formed in one piece from a known plastic material using known molding or forming processes. A preferred material for shell 31 is believed to be a relatively hard plastic such as polycarbonate, but other moldable or formable plastic materials known to those skilled in the art can be used; at least some of the plastic materials commonly used for the shell portions of modern plastic hockey boots should also be suitable. The hardness of the material in a given shell thickness should be sufficient to withstand blows from hockey pucks and hockey sticks without deflecting into contact with the boot shell, or permanently deforming, or cracking. In the illustrated embodiment, the thickness of shell 31 is on the order of one-eighth of an inch (0.125"), although thinner and thicker shells can be used depending on the desired degree of protection and the material used. The material should also have enough flexibility, even at the low temperatures in which ice hockey is played, that it can be flexed sufficiently by hand to fit over the top of boot 10 as shown in FIGS. 1 and 5. Boot cover might be formed in multiple pieces and then joined by mechanical or adhesive or welding type means, but one-piece molded construction is preferred.

Shell 31 is substantially uniformly spaced from the surface of boot shell 14 by spaced pads 33 located on the inner surfaces of the sides and instep of portions of the shell. The pads are preferably made from a known protective padding material such as, but not limited to, closed cell foam or cushioning gel material, and many of the known types used in protective sports equipment padding should be suitable provided they can be cut or formed with a suitable thickness. The pads can be secured to the inside of shell 31 using known means including but not limited to adhesives and mechanical fasteners. Pads of suitable thickness space the hard plastic shell 31 of cover 30 away from the shell of boot portion 14, such that the protective shell 31 "floats" above and around the shell of the boot with an air gap 31*a* (except where the padding is in contact with the boot shell). An exemplary thickness for the padding is approximately 14-inch, although lesser and greater thicknesses can be used depending on the degree of protection and shock absorption desired from the spacing between shell 31 and boot 14 and from the padding material itself. The thickness of the different pads can be varied depending on their location on the boot.

The outer shell 14 of skate boot 10 is typically made from a hard plastic or composite material or stiffened leather, and has sides 16, toe portion 18, a top or instep 20, ankle regions 22 on each side, a heel 24, and a bottom or sole 26. Boot 10 is shown with instep laces 28, but it will be understood that cover 30 can be adapted to boots with other forms of boot closure such as buckles or straps or hook-and-loop closures, and to boots with closures other than over the instep.

Figure 2:
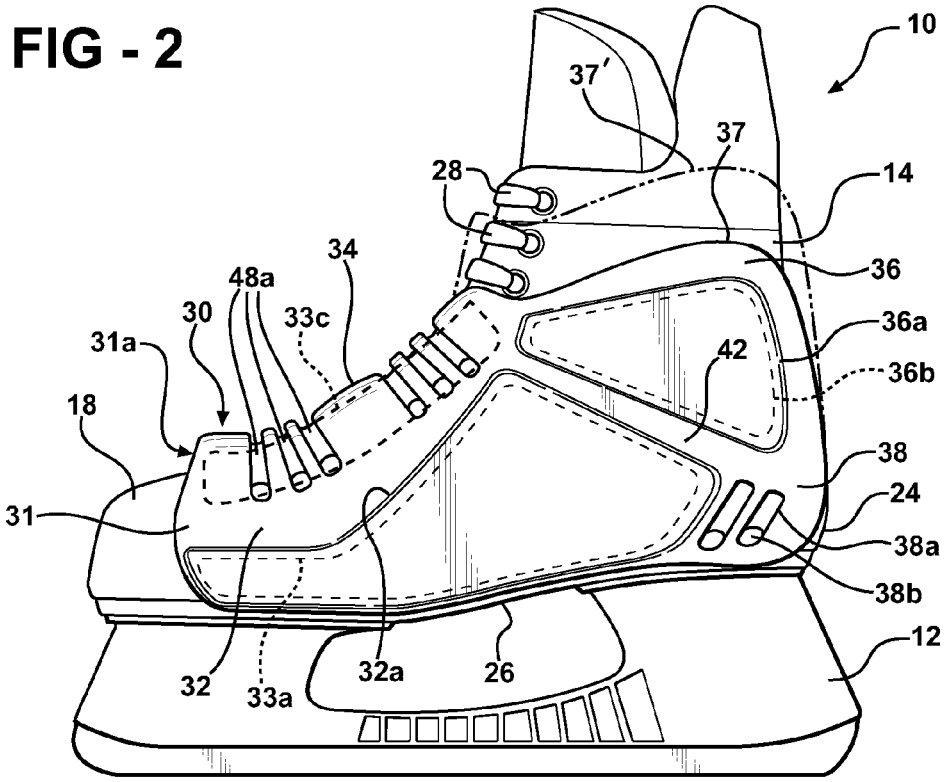
FIG. 2 shows the boot cover of FIG. 1 fitted to the boot in solid lines, and shows spaced padding on the underside of the cover in hidden lines.
Figure 3:
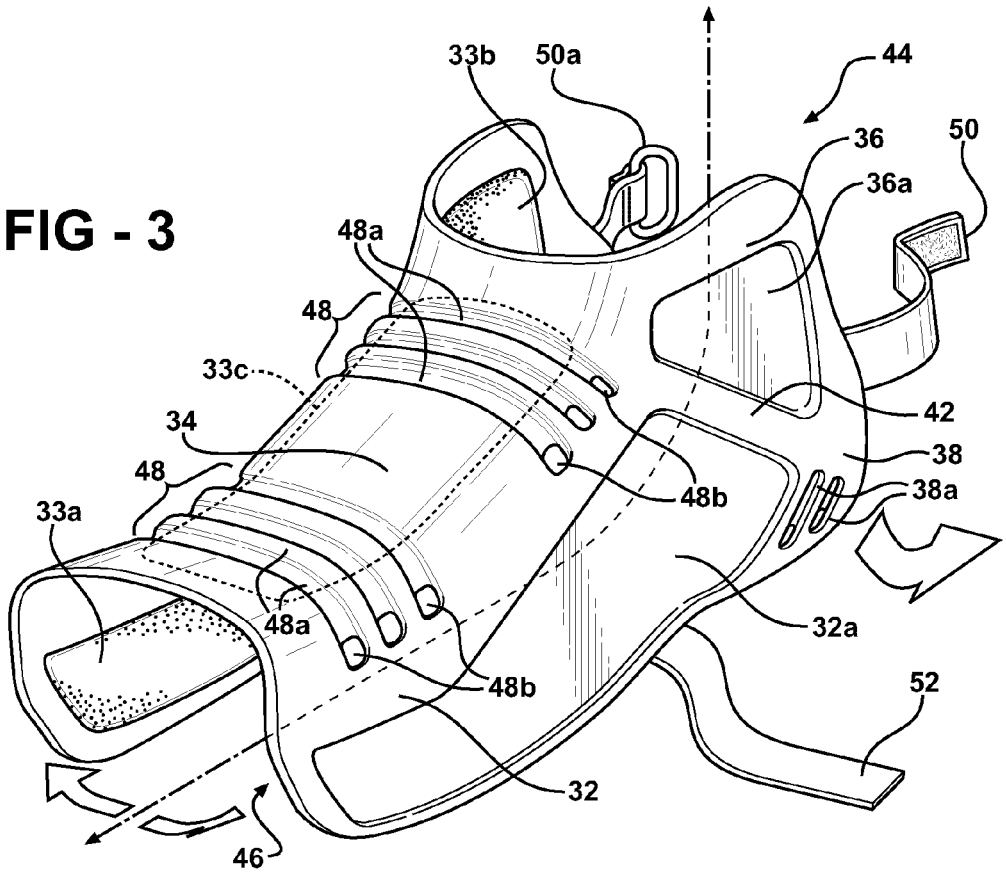
FIG. 3 is a front perspective view of the boot cover of FIG. 1, with the diagonal flex bias of the cover shown by arrows.
Figure 4:
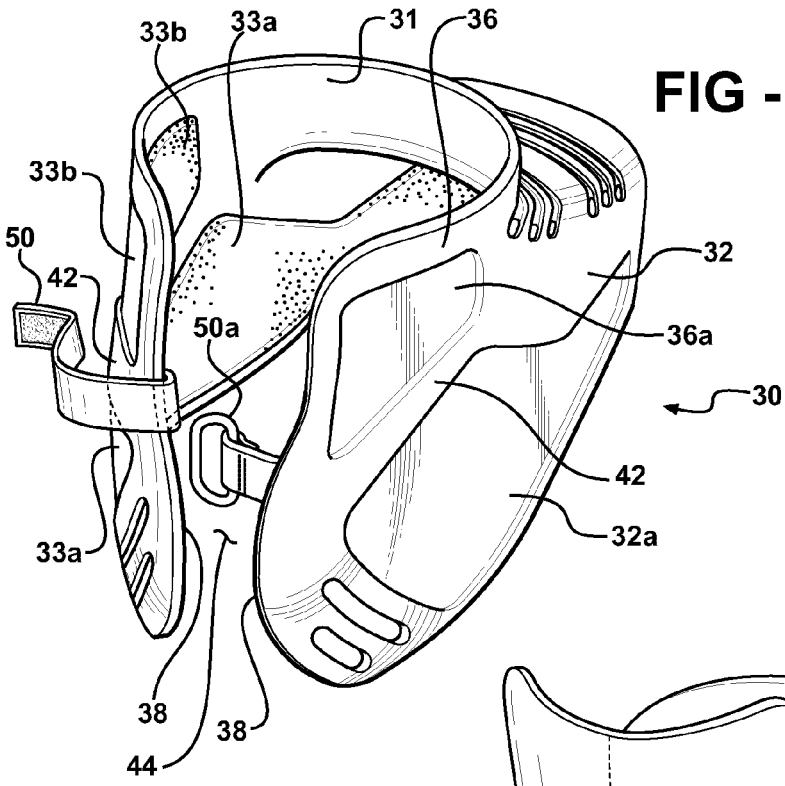
FIG. 4 is a rear perspective view of the boot cover of FIG. 1 in a relaxed state.

Referring to FIGS. 1 through 4, boot cover shell 31 has sidewalls 32, a top or instep wall 34, ankle-covering sidewall extensions 36 on each side, partial rear heel cups 38 on each side, relief areas 32*a* and 36*a* formed over the sidewalls and ankle regions, a non-relieved sidewall portion 42 forming a flex-biasing reinforcement "strap" or beam on each sidewall running from the heel cup area diagonally toward the instep, a split rear opening 44 contiguous with an open bottom 46, and spaced upper slotted regions 48 over the instep. The split rear opening 44 is preferably supplied with a self-adhering hook-and-loop strap 50 of known type (or equivalent releasable connector such as a lace, cord, buckle, opposing hook-and-loop pieces, etc.) secured to one rear edge 39 of the cover (preferably permanently, for example with adhesive or a rivet) and secured removably to the other rear edge 39 of the cover, for example by threading the strap through a strap ring or buckle 50*a* affixed to the other rear edge 39 as shown in FIGS. 3 and 4 and doubling the strap back on itself in known manner. It will be understood that the bottom edges of cover 30 are optionally secured and further tensioned with a connector running under the sole of boot 10, for example with a strap 52 or equivalent releasable connector (FIG. 3) secured to one lower sidewall edge of shell 31 and removably secured to the opposite lower sidewall edge of shell 31 in a manner similar to strap 50.

Strap 50 is preferably elastic to best accommodate the flex of cover 30 (and corresponding flex of the boot) on the "powerstroke" of the skating stride. The boot laces are easily adjusted by simply undoing strap 50 and lifting cover 30 for access to the laces. Strap 50 and ring 50*a* are omitted from FIGS. 1, 2, and 5 for clarity, but it will be understood that they (or portions thereof) would normally be visible in these views.

Relief areas 32*a* and 36*a* on the sidewalls of shell 31 are areas of reduced wall thickness, such that sidewall region 42 separating the ankle region 36 from the sidefoot region 32 on each side of the shell has a greater thickness and accordingly greater tension (flex) bias running diagonally between the instep 34 and the heel cups 38. This makes it easiest to flex shell 31 open diagonally from the heel cups 38, and causes the shell to naturally close diagonally on boot 10 from the instep toward the heel cups, with the heel cups 38 tensioned toward one another to conformingly wrap partway around the rounded heel 24 of the boot, as best shown in FIG. 5. A similar flex bias could be achieved by simply increasing the wall thickness of (or otherwise reinforcing) a diagonal heel-to-instep portion of the sidewall.

Pads 33*a*, 33*b*, and 33*c* space shell 31 from the surface of boot shell 14, with the exception of heel cups 38 where it is not necessary. The heels 24 of modern hockey skate boots are often already reinforced with rigid heel-defining and heel-supporting members built into the boot, and accordingly might require less protective shielding than other portions of the boot. Rear edges 39 follow the curved contour of the back-strap or Achilles portion 24*a* of the boot above heel 24. The rear edges 39 of the split heel of shell 31 remain spaced apart, at least while cover 30 is on the boot.

Flex-accommodating instep regions 48 comprise "slots" 48*a*, which in the illustrated embodiment are areas of reduced shell wall thickness rather than true slots through which the boot is exposed. Vents 48*b* passing fully through the shell to let air flow to and from the boot through the cover can optionally be provided in one or more places in one or more of the slots. Slotted regions 48 provide additional shell flex at the portions of the instep subject to the greatest flexing of the underlying boot during vigorous skating, and additionally reduce the weight of covers 30. It will be understood that more or fewer slots than shown are possible, that more or fewer than two spaced regions of slots are possible, and that the number, length, width, shape, and spacing of the slots can vary from the preferred, illustrated example. In the illustrated embodiment, instep padding 33*c* runs along a substantial portion of the length of the instep, including under the slotted regions 48, without covering vents 48*b*.

Heel cup portions 38 of shell 30 can also be provided with slots 38*a*, similar to slots 48 including the option of vents 38*b*. Slots 38*a* increase the flexibility of the heel cups 38, provide a place to grip the outer part of the cover 30 when flexing the heel cups to put the cover on and to take it off, and further reduce weight.

FIG. 2 illustrates a preferred height for cover 30 relative to boot 10 in solid lines. Phantom lines at 37' illustrate an alternate height for the uppermost edge 37 of cover 30.

To put cover 30 on boot 10, the user grasps the edges of heel cupping portions 38 and spreads them diagonally apart far enough to fit the cover diagonally over the instep 20 of boot 10 toward heel 24, as illustrated by the arrows in FIGS. 1 and 3. When cover 30 is in place, for example when the padding 33*c* on the instep portion 34 of the cover comes into contact with the instep portion 20 of the boot, the user simply releases the spread-apart heel-cupping portions 38. The diagonal bias molded or formed into shell 31 and especially running along the reinforcement portion 42 of sidewalls 32 into heel cups 38 causes the shell to try to return to its at-rest or relaxed dimensions, which are narrower than the corresponding sidewall and heel portions of boot 10. Shell 31 accordingly grips boot 10 in a tensioned fit through its spaced pads 33, as best shown in FIG. 5, with heel cupping portions 38 wrapping partway around and cupping the rounded heel 24 of boot 10. To best secure cover 31 to boot 10, straps or other fasteners 50 and 52 are fastened across the heel and under the sole of the boot as described above.

The tension of heel cups 38 on the heel of the boot holds cover 30 firmly enough in place that any straps or other supplemental fasteners such as 50 and 52 can be fastened without having to use a hand to stabilize cover 30 in place on the boot.

It will finally be understood that the disclosed embodiments are representative of presently preferred forms of the invention, but are intended to be illustrative rather than definitive of the invention. The scope of the invention is defined by the following claims.

I accordingly claim:

1. A protective cover for a hockey skate boot, the cover comprising:

a one-piece molded protective shell having sidewalls covering substantial portions of the ankles and sides of the boot, the sidewalls connected by an instep-covering top portion and spaced by an open bottom and contiguous split rear, the shell comprising heel-cupping sidewall portions adapted to partially wrap around opposite sides of a rounded heel portion of a hockey skate boot, the heel-cupping sidewall portions capable of being flexed apart by hand to fit the cover diagonally over a top instep portion of a boot, the shell having a molded-in flex bias along a diagonal line from the heel-cupping portions toward the instep-covering top portion tending to draw the heel-cupping sidewall portions together to grip a rounded heel portion of a boot when the heel-cupping sidewall portions are released; and, spaced pads on an underside of the shell, the spaced pads spacing the shell from the boot.

2. The protective cover of claim 1, wherein the spaced pads comprise spaced side-foot and ankle pads on each sidewall of the shell.

3. The protective cover of claim 2, wherein the side-foot and ankle pads on each sidewall are spaced by a reinforced portion of each sidewall extending diagonally between the heel-cupping sidewall portions and the instep-covering top portion of the cover.

4. The protective cover of claim 2, wherein the spaced pads include an instep pad.

5. The protective cover of claim 4, wherein the instep-covering top portion comprises spaced slotted relief areas.

6. The protective cover of claim 5, wherein the instep pad is located between the spaced slotted relief areas.

7. The protective cover of claim 3, wherein the reinforced portion of each sidewall is defined by relief areas of reduced wall thickness adjacent the reinforced portion.

8. The protective cover of claim 7, wherein the side-foot and ankle pads underlie the relief areas.

9. The protective cover of claim 1, wherein the instep-covering top portion is slotted to improve flexibility.

10. The protective cover of claim 1, wherein the heel-cupping sidewall portions are slotted to improve flexibility.

* * * * *